US006666755B1

(12) United States Patent
Taylor et al.

(10) Patent No.: US 6,666,755 B1
(45) Date of Patent: Dec. 23, 2003

(54) BELT WIPER FOR A CHEMICAL MECHANICAL PLANARIZATION SYSTEM

(75) Inventors: Travis R. Taylor, Fremont, CA (US); Christian DiPietro, Sunnyvale, CA (US); Stephen Jew, Santa Clara, CA (US); Philip Ngoon, San Jose, CA (US); Katgenahalli Y. Ramanujam, Fremont, CA (US); Tony Luong, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/184,163

(22) Filed: Jun. 26, 2002

(51) Int. Cl.[7] ..... B24B 1/00

(52) U.S. Cl. ..... 451/56; 451/288; 451/285; 451/296; 451/533

(58) Field of Search ..... 451/56, 285–289, 451/41, 533, 296, 355

(56) References Cited

U.S. PATENT DOCUMENTS

| | | | | | |
|---|---|---|---|---|---|
| 3,571,979 | A | * | 3/1971 | Manchester | 451/56 |
| 5,690,705 | A | * | 11/1997 | Holmes et al. | 51/295 |
| 5,961,372 | A | * | 10/1999 | Shendon | 451/41 |
| 6,419,559 | B1 | * | 7/2002 | Gurusamy et al. | 451/41 |
| 6,428,394 | B1 | * | 8/2002 | Mooring et al. | 451/41 |
| 6,468,134 | B1 | * | 10/2002 | Gotkis | 451/36 |
| 6,554,688 | B2 | * | 4/2003 | Lacy | 451/56 |
| 2002/0086620 | A1 | * | 7/2002 | Lacy | 451/56 |

* cited by examiner

*Primary Examiner*—Lee D. Wilson
(74) *Attorney, Agent, or Firm*—Martine & Penilla, LLP

(57) ABSTRACT

A belt wiper that can be used in a linear belt-type chemical mechanical planarization (CMP) system to maintain a belt pad is provided. The belt wiper mitigates disturbances within a detection region important to a belt pad steering system. Also, the belt wiper mitigates the obscuring of optical components important to operation of an endpoint detection system. Thus, the belt wiper, by wiping the underside of the belt pad will preserve the functionality of both the belt pad steering system and the endpoint detection system.

18 Claims, 9 Drawing Sheets

BELT WIPER FOR A CHEMICAL MECHANICAL PLANARIZATION SYSTEM

BACKGROUND OF THE INVENTION

1. Field of the Invention

The present invention relates generally to chemical mechanical planarization (CMP) methods and systems, and more particularly, to a belt wiper for removing fluid and particulate material that can interfere with a CMP process.

2. Description of the Related Art

In the fabrication of semiconductor devices, planarization operations on silicon wafers, which can include planarizing, polishing, buffing, and cleaning, are often performed. Typically, integrated circuit devices are in the form of multi-level structures on silicon substrate wafers. At the substrate level, transistor devices with diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide. As more metallization levels and associated dielectric layers are formed, the need to planarize the dielectric and metal layers increases. Without planarization, fabrication of additional metallization layers becomes substantially more difficult due to the higher variations in the surface topography.

Planarizing metallization layers is becoming more important due to replacement of aluminum with copper as the metal of choice for metallization processes. One method for achieving semiconductor wafer planarization is the chemical mechanical planarization (CMP) technique. Further applications include planarization of dielectric films deposited prior to the metallization process, such as dielectrics used for shallow trench isolation or for poly-metal insulation. CMP systems typically implement a rotary, an orbital, or a linear pad system in which a preparation surface of a polishing pad is used to polish one side of a wafer. In general, the CMP process involves applying a controlled pressure to a typically rotating wafer that is in contact with a moving polishing pad coupled with a slurry containing a mixture of abrasive materials and chemicals to facilitate the planarization process. Slurry is most usually introduced onto a moving preparation surface and distributed over the preparation surface as well as the surface of the semiconductor wafer being prepared by the CMP process. The distribution of the slurry is generally accomplished by a combination of the movement of the preparation surface, the movement of the semiconductor wafer and the fluid dynamics between the semiconductor wafer and the preparation surface.

FIG. 1 shows a conventional linear belt-type CMP system 100. The conventional linear belt-type CMP system 100 includes a polishing head 108, also known as a wafer carrier, which secures and holds a wafer 104 in place during CMP processing. A belt pad 102, also known as a linear polishing belt, is disposed in the form of a band around rotating drums 112. The belt pad 102 is composed of materials that provide structural integrity and facilitate the planarization/polishing of the CMP process. The belt pad 102 moves in a direction 106 at a speed of up to approximately 1000 feet per minute; however, this speed may vary depending upon the specific CMP process. As the belt pad 102 moves, the polishing head 108 rotates and lowers the wafer 104 onto the top surface (i.e., the preparation surface) of the belt pad 102. The wafer 104 is applied to the belt pad 102 with a force 118 sufficient to facilitate the CMP process.

A fluid bearing platen manifold assembly 110 supports the belt pad 102 during the CMP process. Typically, the fluid bearing platen manifold assembly 110 utilizes a pressurized gas bearing. The pressurized gas bearing, typically composed of clean dry air, is provided by a gas source 114 and is input through the fluid bearing platen manifold assembly 110 via several independently controlled dispersion holes. The pressurized gas bearing provides upward force on the belt pad 102 to control the profile of the belt pad 102.

A slurry 122 is delivered to the belt pad 102 by a slurry manifold 120 including many nozzles. The slurry manifold 120 dispenses the slurry 122 on the top surface of the belt pad 102. Movement of the belt pad 102 in the direction 106 transports slurry 122 underneath the wafer 104. The slurry manifold 120 is typically aligned in a position relative to the wafer 104 such as center on the wafer 104. However, the position of the slurry manifold 120 can be adjusted to somewhat optimize the uniformity of the removal of material from the surface of the wafer 104.

A pre-wet manifold 124 containing a number of dispersion holes 126 is positioned at a leading edge of a platen assembly 135, where the leading edge is defined relative to the belt pad 102 movement direction 106. A fluid, typically deionized water, flows through the dispersion holes 126 of the pre-wet manifold 124 to provide both rinsing and lubrication of the underside of the belt pad 102 and the fluid bearing platen manifold assembly 110. Prior to reaching the pre-wet manifold 124, the edge of the belt pad 102 passes by a belt-tracking sensor 128. The belt-tracking sensor 128 is used to sense the position of the belt pad 102 edge so that the belt pad 102 can be steered accurately while traveling around the rotating drums 112 in the direction 106.

FIG. 2 shows a top view of the platen assembly 135. The platen assembly 135 includes the fluid bearing platen manifold assembly 110. Pressurized gas flows out of a number of dispersion holes 136 to provide support and lubrication to the belt pad 102 as it traverses the platen assembly 135. Also, a platen optics window 130 is located at the center of the fluid bearing platen manifold assembly 110. The platen optics window 130 is a component of an endpoint detection system which measures a wafer film thickness and signals when the CMP process is finished. The pre-wet manifold 124 containing the number of dispersion holes 126 is also shown attached to the leading edge of the platen assembly 135 with respect to the belt pad 102 direction 106.

FIG. 3 shows a top view of the belt pad 102 traversing the pre-wet manifold 124 and the platen assembly 135 in the direction 106. The belt pad 102 contains a belt window 132 which passes over the platen optics window 130 as the belt pad 102 traverses the platen assembly 135. The belt-tracking sensor 128 is also shown in relation to the belt pad 102 edge and platen assembly 135. By monitoring a distance across a region 134 between the belt-tracking sensor 128 and the belt pad 102 edge, the belt pad 102 can be accurately steered as it travels around the rotating drums 112.

The belt-tracking sensor 128 operates based on sound wave propagation and detection. The belt-tracking sensor 128 generates and directs sound waves toward the belt pad 102 edge. The sound waves are reflected back from the belt pad 102 edge to the belt-tracking sensor 128 where they are detected. A propagation time required for the sound waves to travel to the edge of the belt pad 102 and return to the belt-tracking sensor 128 is used to accurately determine the position of the belt pad 102 edge. The sound wave propagation time can be affected by variations in the region 134 through which the sound wave travels. Normally, the belt pad 102 edge position is determined using the sound wave propagation time and assumptions regarding the prevailing characteristics of the region 134 between the belt-tracking sensor 128 and the belt pad 102 edge. During a CMP process, air from the fluid bearing platen manifold assembly 110 blows through both the fluid provided by the pre-wet manifold 124 and any excess slurry 122 on the underside of the belt pad 102 resulting in a disturbance of the region 134 between the belt-tracking sensor 128 and the belt pad 102 edge. The air, fluid, and slurry 122 disturbance causes a change in the density of the region 134 resulting in a corresponding change in sound wave propagation velocity within the region 134. Therefore, the assumptions regarding the prevailing characteristics of the region 134 combined with the actual sound wave propagation time as measured by the belt-tracking sensor 128 will result in an erroneous determination of the belt pad 102 position. An inability to correctly determine the position of the belt pad 102 prohibits effective belt pad 102 steering. Thus, a problem with the prior art is belt pad 102 steering inaccuracies caused by the intrusion of air, pre-wet fluid, and slurry 122 into the region 134 between the belt-tracking sensor 128 and the belt pad 102 edge.

As previously discussed, the platen optics window 130 and belt window 132 are components of the endpoint detection system used to determine when a CMIP process is completed. Completion of a CMP process is determined by performing an active interrogation of the wafer 104 surface to determine if the desired wafer 104 surface condition has been achieved. The active interrogation in performed using an optical method wherein light is pulsed from an optical device in the platen optics window 130 toward the surface of the wafer 104. The light pulse reflects off the wafer 104 toward the platen optics window 130. The characteristics of the reflected light are used to determine the condition of the wafer 104 surface. When the wafer 104 surface condition achieves the desired results the CMP process is terminated. The belt window 132 allows the light pulse to travel from the platen optics window 130 to the wafer 104 surface and back to the platen optics window 130 to be analyzed. A problem with the prior art is that during the CMP process, slurry 122 and fluid cause both the platen optics window 130 and belt window 132 to become obscured such that the intensity of the light pulse used for endpoint detection is adversely affected.

In view of the foregoing, there is a need for an apparatus and method that can be implemented in a CMP process to prevent belt pad 102 steering inaccuracies caused by the intrusion of air, fluid, and slurry 122 into the region 134 between the belt-tracking sensor 128 and the belt pad 102 edge. Furthermore, there is a need for an apparatus and method that can be implemented in a CMP process to prevent the platen optics window 130 and belt window 132 from becoming obscured by slurry 122 and fluid such that optical endpoint detection is not adversely affected.

SUMMARY OF THE INVENTION

Broadly speaking, the present invention fills these needs by providing apparatuses and methods for a belt wiper that can be used in a linear belt-type chemical mechanical planarization (CMP) system to maintain a belt pad in a manner that preserves the functionality of both a belt pad steering system and an endpoint detection system. It should be appreciated that the present invention can be implemented in numerous ways, including as a process, an apparatus, a system, a device, or a method. Several embodiments of the present invention are described below.

In one embodiment, a linear belt-type CMIP system is disclosed. The linear belt-type CMP system includes a first drum and a second drum. A belt pad having a width, a preparation surface, and an undersurface is configured around the first drum and the second drum. As the first drum and second drum rotate, the belt pad moves linearly. A platen provides support at a wafer preparation location where a wafer contacts the belt pad preparation surface during a CMIP process. More specifically, the wafer preparation location is located between a first platen side and a second platen side. The belt pad is configured to traverse over the wafer preparation location in a direction from the first platen side to the second platen side. The first platen side contains a plurality of delivery holes through which a gas is delivered to condition the undersurface of the belt pad prior to traversing the platen. The second platen side contains a plurality of delivery holes through which a liquid is delivered to condition the undersurface of the belt pad after traversing the platen. A wiper blade is positioned between the first drum and the second drum and inside of the belt pad. The wiper blade is configured to extend across width of the belt pad and to be in contact with the undersurface of the belt pad. In this configuration, the wiper blade is capable of removing fluid and particulate material from the underside of the belt pad. The wiper blade is generally configured to remove fluid and particulate material from the undersurface of the belt pad at a position next to the wafer preparation location. In a preferred embodiment, the wiper blade is attached to the first platen side. However, in other embodiments a plurality of wiper blades may be utilized and configured to contact the undersurface of the belt pad at an arbitrary number of positions between the first drum and second drum and inside the belt pad. The wiper blade can be configured to contact the undersurface of the belt pad in either a perpendicular or non-perpendicular manner. The wiper blade further includes a gutter that is configured to flow fluid and direct particulate material removed by the wiper blade toward each of the gutter ends. The gutter ends are formed to direct a flow of fluid and particulate material away from the gutter and away from the belt pad.

In another embodiment, a belt wiper assembly for use in a CMP system is disclosed, wherein the CMP system includes a linear polishing belt having a preparation surface and an undersurface. The belt wiper assembly includes a support body disposed within the linear polishing belt, a bracket attached to the support body, and a blade attached to the bracket. The bracket includes a gutter that is configured to extend across the width of the linear polishing belt. The ends of the gutter can be notched if necessary to direct a flow of fluid and particulate material. The blade is configured to contact the undersurface of the linear polishing belt in either a perpendicular or non-perpendicular manner. The blade contacting the undersurface of the linear polishing belt is flexible and can be shaped to enhance removal of fluid and particulate material.

In yet another embodiment, a method for maintaining an underside of a linear polishing belt of a CMP system is disclosed. Generally speaking, the method includes moving the linear polishing belt while wiping the underside of the linear polishing belt. More specifically, a wiping operation is performed prior to movement of the linear polishing belt over a wafer preparation location. Following the wiping operation, a drying of the underside of the linear polishing belt is performed prior to movement of the linear polishing belt over the wafer preparation location. Once the linear polishing belt moves over the wafer preparation location, a wetting of the underside of the linear polishing belt occurs.

In alternate embodiments, numerous wiping operations are implemented using a plurality of wiper blades configured to contact the undersurface of the linear polishing belt at an arbitrary number of locations.

The advantages of the present invention are numerous. Most notably, the use of the belt wiper in the CMP system as disclosed in the present invention avoids the problems of the prior art by providing a device and method for preventing belt pad steering inaccuracies caused by the intrusion of air, fluid, and slurry into the region between the belt-tracking sensor and the belt pad edge. Furthermore, the use of the belt wiper in the CMP system provides a device and method that prevents the platen optics window and belt window from becoming obscured by slurry and fluid such that optical endpoint detection is adversely affected.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a belt wiper that can be used in a linear belt-type chemical mechanical planarization (CMP) system to maintain a belt pad. The belt wiper of the present invention mitigates disturbances within a detection region important to a belt pad steering system. Also, the belt wiper mitigates the obscuring of optical components important to operation of an endpoint detection system. Thus, the belt wiper of the present invention eliminates problems of the prior art by preserving the functionality of both the belt pad steering system and the endpoint detection system.

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1:
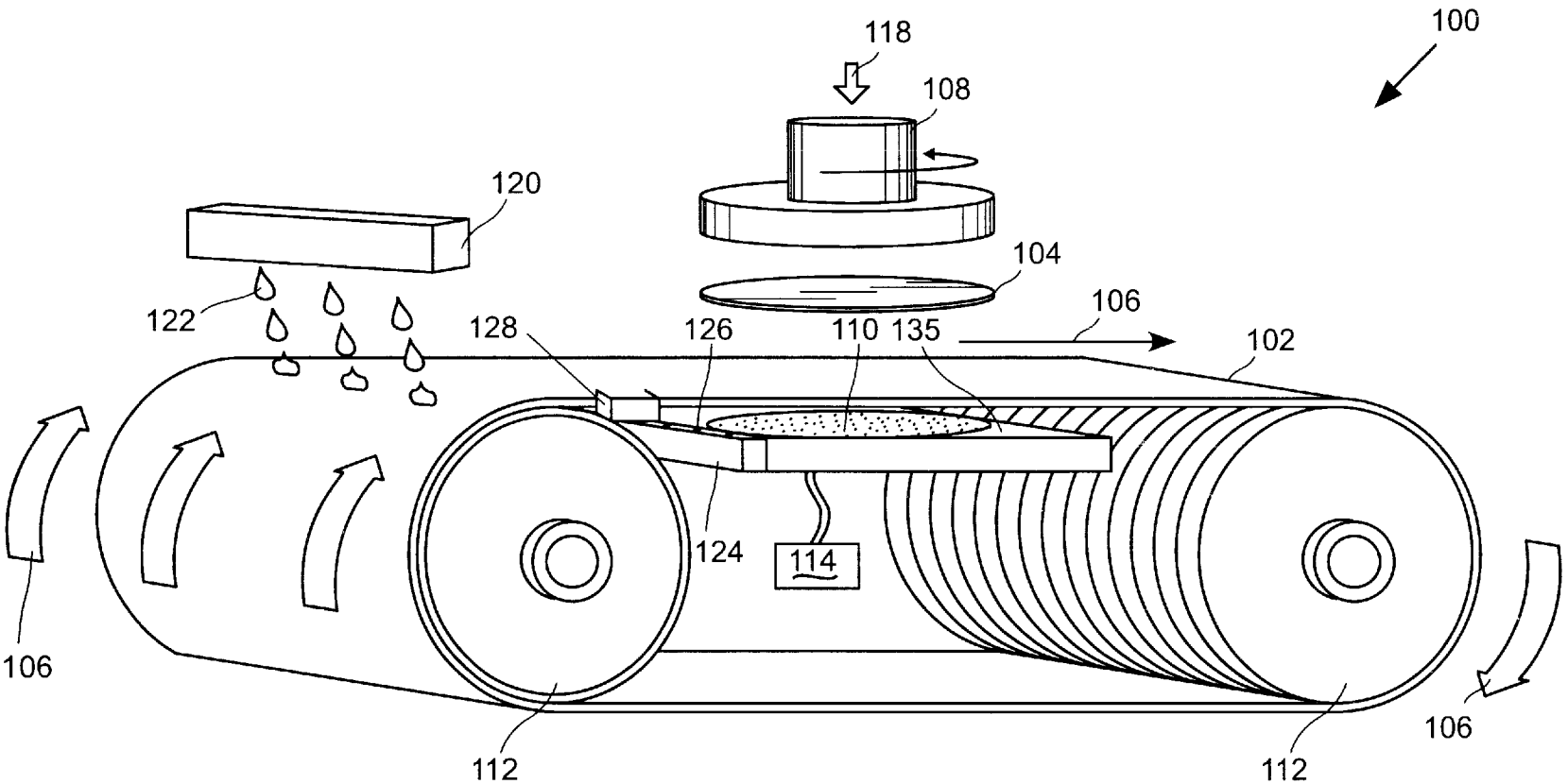
FIG. 1 (Prior Art)
FIG. 1 is an illustration showing a prior art conventional linear belt-type CMP system.
Figure 2:
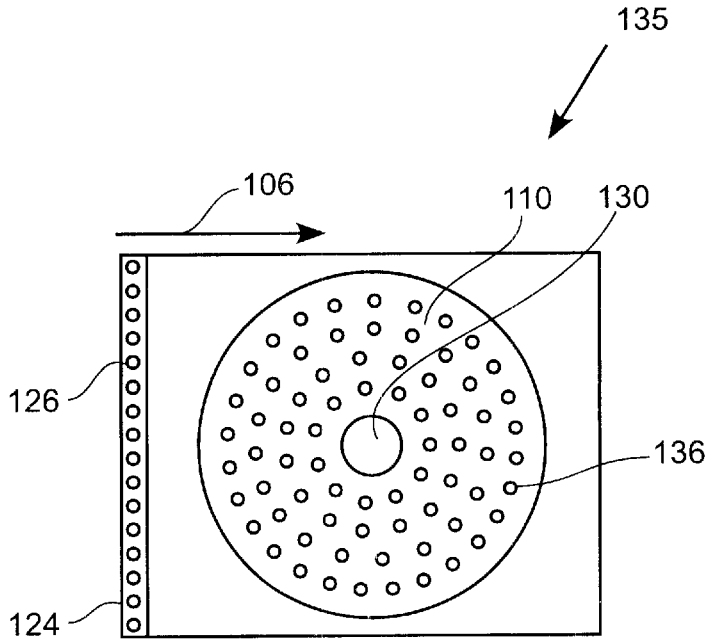
FIG. 2 (Prior Art)
FIG. 2 is an illustration showing a top view of a prior art platen assembly.
Figure 3:
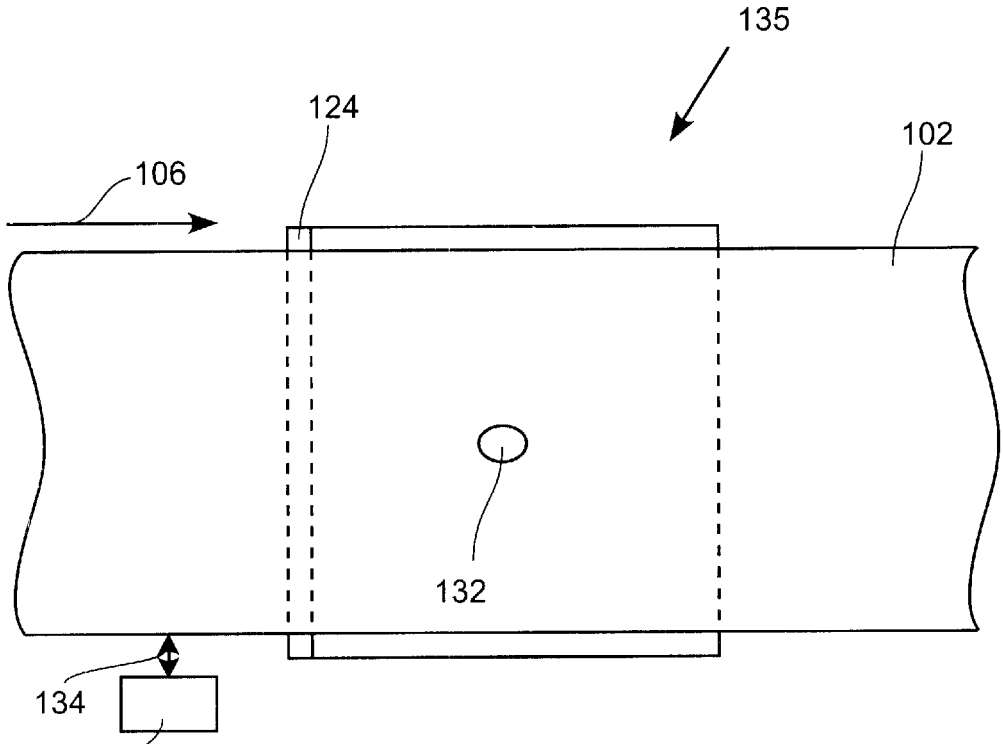
FIG. 3 (Prior Art)
FIG. 3 is an illustration showing a top view of a prior art belt pad traversing the pre-wet manifold and the platen assembly.
Figure 4:
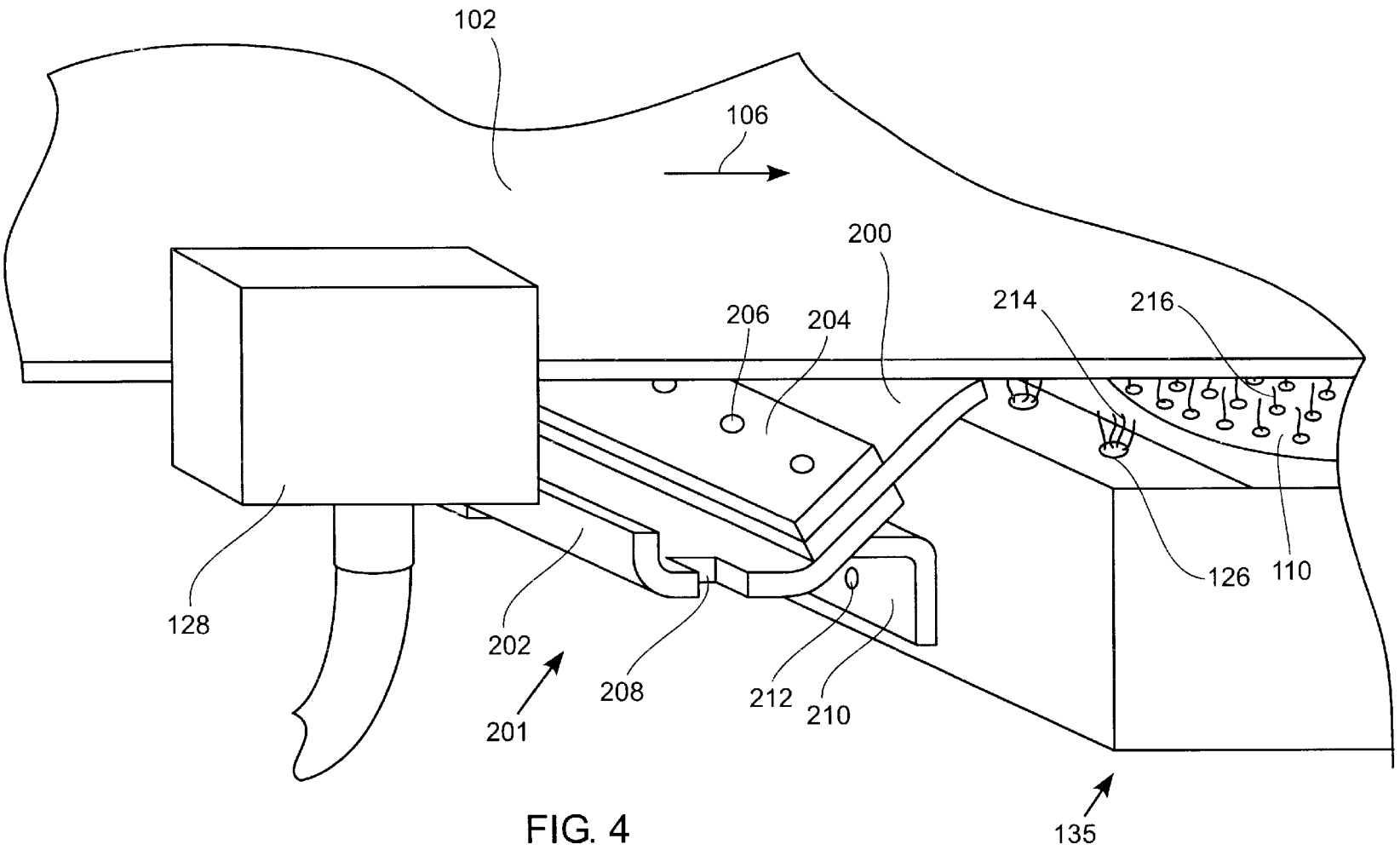
FIG. 4 is an illustration showing a belt wiper assembly incorporated into a CMP system in accordance with a preferred embodiment of the present invention.

FIG. 4 shows a belt wiper assembly 201 incorporated into a CMP system in accordance with a preferred embodiment of the present invention. The belt wiper assembly 201 includes a wiper blade 200 configured between a locking bar 204 and a gutter 202. The locking bar 204, wiper blade 200, and gutter 202 are held together by a plurality of fasteners 206. Each of the gutter 202 ends are formed with a notch 208 to direct a flow of fluid and particulate material away from the gutter 202. The gutter 202 is supported underneath by a bracket 210 wherein the gutter 202 and bracket 210 are held together with a plurality of fasteners 218 (see FIG. 5). The bracket 210 is attached to a support body using a plurality of fasteners 212. In a preferred embodiment, the support body is the platen assembly 135. Of course, other support mechanisms will also work, so long as the wiper blade 200 is supported.

A plurality of delivery holes 126 are configured at a leading edge of the platen assembly 135 to deliver clean dry air (CDA) 214 (see FIGS. 4 and 5) against the undersurface of the belt pad 102. The platen assembly 135 further comprises the fluid bearing platen manifold assembly 110 which provides an air bearing 216 (see FIGS. 4 and 5) composed of CDA to support the belt pad 102 as it moves in direction 106 over the platen assembly 135. Additionally, a plurality of post-wet delivery holes 222 (see FIG. 7) are positioned at a trailing edge of the platen assembly 135 to provide a post-wet fluid 220 (see FIG. 5) to the undersurface of the belt pad 102. The wafer 104 contacts the belt pad 102 at a wafer preparation location 203 (see FIG. 5) located directly above the fluid bearing platen manifold assembly 110.

In a preferred embodiment, the belt wiper assembly 201 is positioned between the belt-tracking sensor 128 and the platen assembly 135. The wiper blade 200 is configured to contact the belt pad 102 undersurface in a substantially non-perpendicular manner. The wiper blade 200 is composed of a flexible material that will adjust to the contours of the belt pad 102 undersurface as the belt pad 102 travels over the wiper blade 200 in direction 106. Also, the wiper blade 200 edge contacting the undersurface of the belt pad 102 can be shaped in wedged manner as required for removal of particular types of slurry 122, fluid, and particulate material. In addition to being flexible, the wiper blade 200 material is preferably non-abrading and chemically inert. In a preferred embodiment, the wiper blade 200 is made of polyurethane. However, the wiper blade 200 can be made of any other material that affords sufficient flexible, non-abrading, and chemically inert characteristics. As the belt pad 102 moves in direction 106, the wiper blade 200 removes fluid and particulate material from the undersurface of the belt pad 102. The fluid and particulate material moves down the wiper blade 200, over the locking bar 204, and into the gutter 202. Once in the gutter 202 the fluid and particulate material move toward the ends of the gutter 202 where they are directed downward through the notch 208. The fluid and particulate material removed from the belt pad 102 by the wiper blade 200 of the present invention can be in the form of a fluid only, a particulate material only, or a combination of fluid and particulate material (e.g., slurry 122). The combination of fluid and particulate material typically behaves as a fluid and is simply referred to as a fluid.

Figure 5:
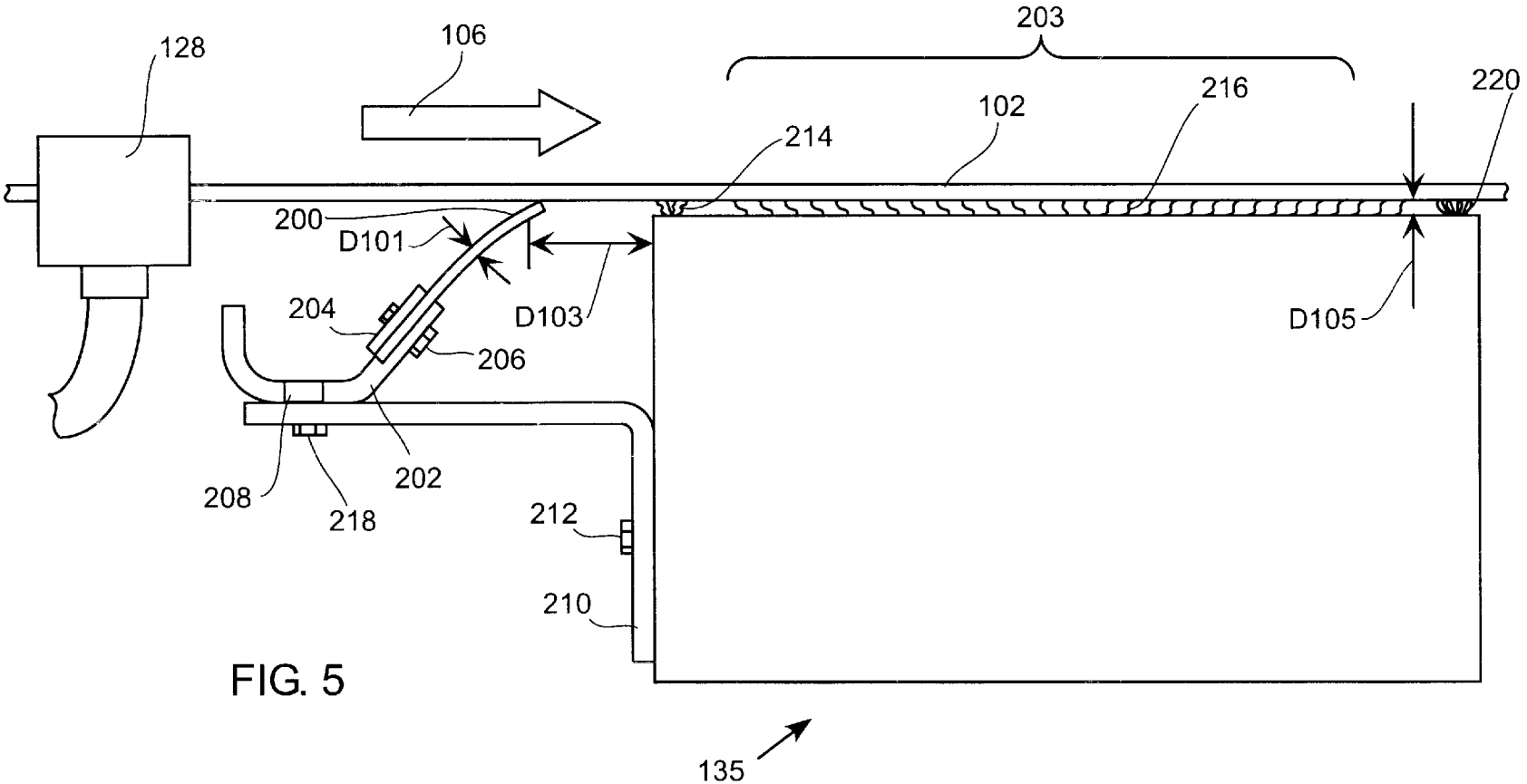
FIG. 5 is an illustration showing a side view of a belt wiper assembly incorporated into a CMP system in accordance with a preferred embodiment of the present invention.

FIG. 5 shows a side view of the belt wiper assembly 201 incorporated into a CMP system in accordance with a preferred embodiment of the present invention. A distance D103 is shown between the wiper blade 200 and the platen assembly 135. In a preferred embodiment, the distance D103 may vary within a range from about 1 inch to about 3 inches. However, the distance D103 is not a critical characteristic affecting the belt wiper performance. Thus, values for distance D103 falling outside the 1 inch to 3 inch range are acceptable in other embodiments. A distance D105 is shown between the belt pad 102 and the platen assembly 135. In a preferred embodiment, the distance D105 generally varies within a range from about 0.001 inch to about 0.013 inch. However, the distance D105 is not a critical characteristic affecting the belt wiper performance so long as the wiper blade 200 remains in contact with the belt pad 102 undersurface as the belt pad 102 travels in direction 106. Thus, the distance D105 may vary outside of the range from 0.001 inch to 0.013 inch as required by the CMP process. Also, the wiper blade 200 is shown having a thickness D101. In a preferred embodiment, the thickness D101 is approximately 0.060 inch. However, the thickness D101 of the wiper blade 200 can be arbitrarily chosen as long as the wiper blade 200 remains flexible and capable of conforming to the contours of the belt pad 102 undersurface.

Figure 6:
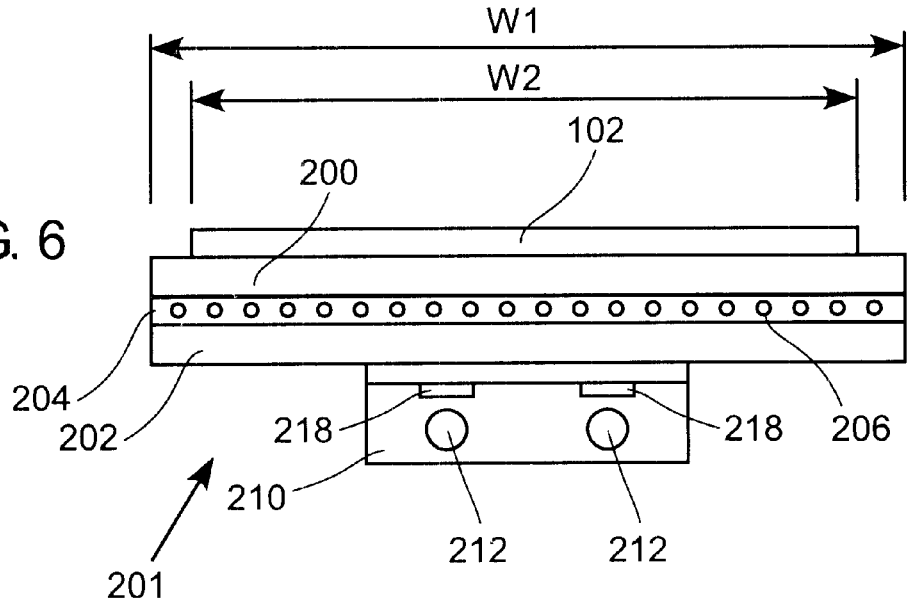
FIG. 6 is an illustration showing a front view of the belt wiper assembly in relation to the belt pad in accordance with one embodiment of the present invention.

FIG. 6 shows a front view of the belt wiper assembly 201 in relation to the belt pad 102 in accordance with one embodiment of the present invention. The wiper blade 200 can have a width W1 greater than or equal to a width W2 of the belt pad 102. In a preferred embodiment, the wiper blade 200 width W1 is slightly greater than the belt pad 102 width W2 to accommodate changes in the belt pad 102 position as it is steered around the rotating drums 112.

During the CMP process, air from the region between the platen assembly 135 and belt pad 102 is directed outward due to the forces applied at the wafer preparation location 203. As the air flows outward, slurry 122, fluid, and particulate material become entrained in the air flow. When either air, slurry 122, fluid, or particulate material travel into the region 134 between the belt-tracking sensor 128 and belt pad 102 edge, the belt pad 102 steering accuracy can be adversely affected. As previously mentioned, a preferred embodiment has the belt wiper assembly 201 positioned between the belt-tracking sensor 128 and the platen assembly 135 such that the wiper blade 200 is contacting the belt pad 102 in a non-perpendicular manner as shown in FIG. 4. The belt wiper assembly 201 configured in this manner substantially shields the region 134 between the belt-tracking sensor 128 and the belt pad 102 edge from projected air, slurry 122, fluid, and particulate material. Therefore, the belt wiper assembly 201 configured between the belt-tracking sensor 128 and platen assembly 135 provides an apparatus and method to prevent belt pad 102 steering inaccuracies caused by the intrusion of air, slurry 122, fluid, or particulate material into the region 134 between the belt-tracking sensor 128 and the belt pad 102 edge.

Figure 7:
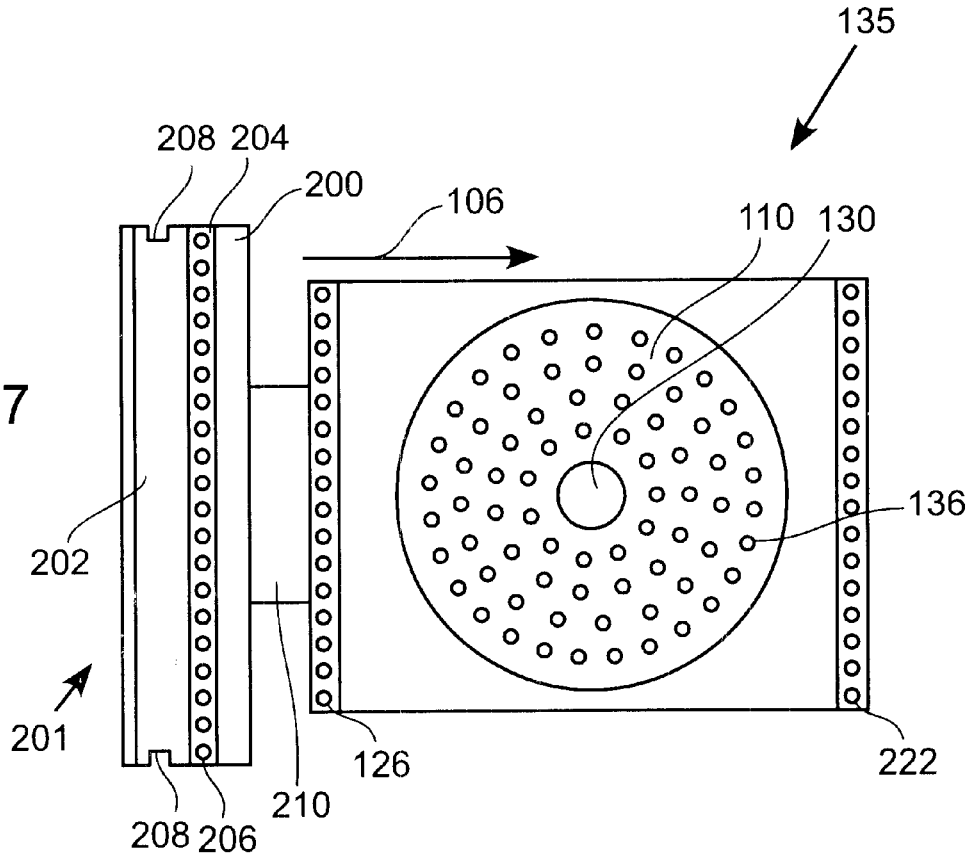
FIG. 7 is an illustration showing a top view of the belt wiper assembly attached to the platen assembly in accordance with one embodiment of the present invention.

FIG. 7 shows a top view of the belt wiper assembly 201 attached to the platen assembly 135 in accordance with one embodiment of the present invention. The platen assembly 135 is shown including the platen optics window 130. As the belt pad 102 travels over the platen assembly 135 the belt window 132 passes over the platen optics window 130. The endpoint detection system depends on the transmission of a light pulse through the platen optics window 130 and belt window 132 when they eclipse one another. If slurry 122 or other fluid and particulate material obscure either the platen optics window 130 or the belt window 132, the light pulse intensity will be diminished such that the endpoint detection system will not function properly. Positioning the belt wiper assembly 201 to allow the undersurface of the belt pad 102 to be wiped prior to passing over the platen optics window 130 will prevent slurry 122, fluid, and particulate material from obscuring the platen optics window 130 and belt window 132.

Figure 8:
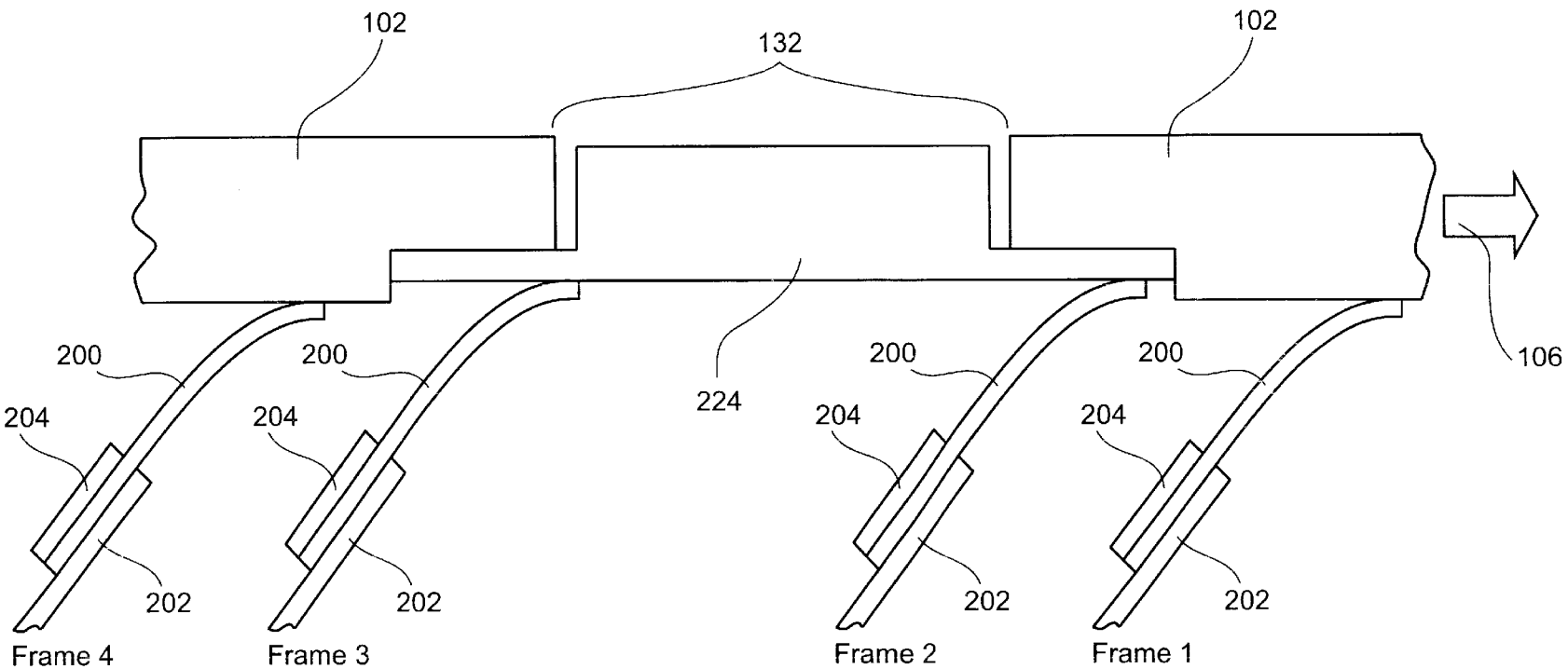
FIG. 8 is an illustration showing the belt window traversing over the wiper blade in accordance with one embodiment of the present invention.

FIG. 8 shows the belt window 132 traversing over the wiper blade 200 in the direction 106 in accordance with one embodiment of the present invention. A Frame 1, a Frame 2, a Frame 3, and a Frame 4 show the belt pad 102 and belt window 132 at different positions relative to the wiper blade 200 as the belt pad 102 traverses over the wiper blade 200. For ease of illustration, multiple instances of the wiper blade 200 are shown. However, the wiper blade 200 remains stationary as the belt pad 102 moves in the direction 106. The belt pad 102 includes a belt window 132 that contains a window insert 224 appropriate for the CMP process. The belt pad 102 shown in FIG. 8 uses a "shaped" window insert 224. However, many different window insert 224 configurations may be used in conjunction with the belt wiper assembly 201 of the present invention. Frame 1 shows the belt window 132 approaching the wiper blade 200. Frame 2 shows the belt window 132 passing over the wiper blade 200. As the belt window 132 passes over the wiper blade 200, the wiper blade 200 flexes to follow the contour of the window insert 224. Frame 3 shows the undersurface of the belt pad 102 approaching the wiper blade 200. Frame 4 shows the undersurface of the belt pad 102 passing over the wiper blade 200. As the undersurface of the belt pad 102 passes over the wiper blade 200, the wiper blade 200 flexes to follow the contour of the undersurface of the belt pad 102. In the aforementioned manner, the wiper blade 200 wipes slurry 122 or other fluid and particulate material from the window insert 224. Therefore, the belt wiper assembly 201 provides an apparatus and method to prevent the platen optics window 130 and belt window 132 from becoming obscured by slurry 122 and other fluid and particulate material such that optical endpoint detection is not adversely affected.

Figure 9:
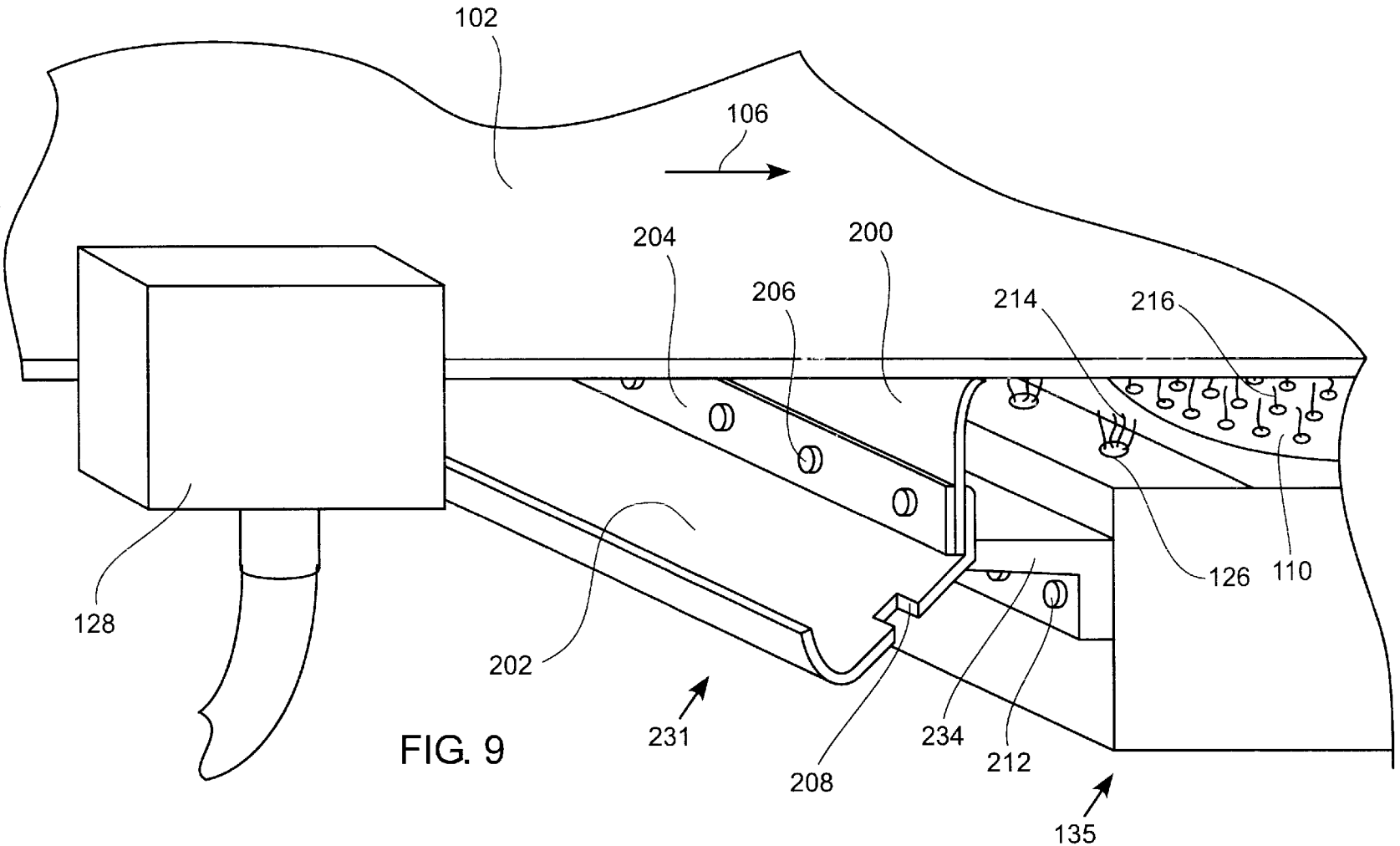
FIG. 9 is an illustration showing a belt wiper assembly configured to contact the belt pad in a perpendicular manner in accordance with an alternate embodiment of the present invention.

In addition to the preferred embodiment, the present invention may be implemented in a number of useful alternate embodiments. FIG. 9 shows an alternate embodiment of a belt wiper assembly 231 configured to contact the belt pad 102 in a perpendicular manner. The belt wiper assembly 231 uses a bracket 234 designed to direct the wiper blade 200 in a direction perpendicular to the undersurface of the belt pad 102. The perpendicular characteristic of the belt wiper assembly 231 can be useful for increasing the rate of movement of slurry, fluid, and particulate material away from the undersurface of the belt pad 102.

Figure 10:
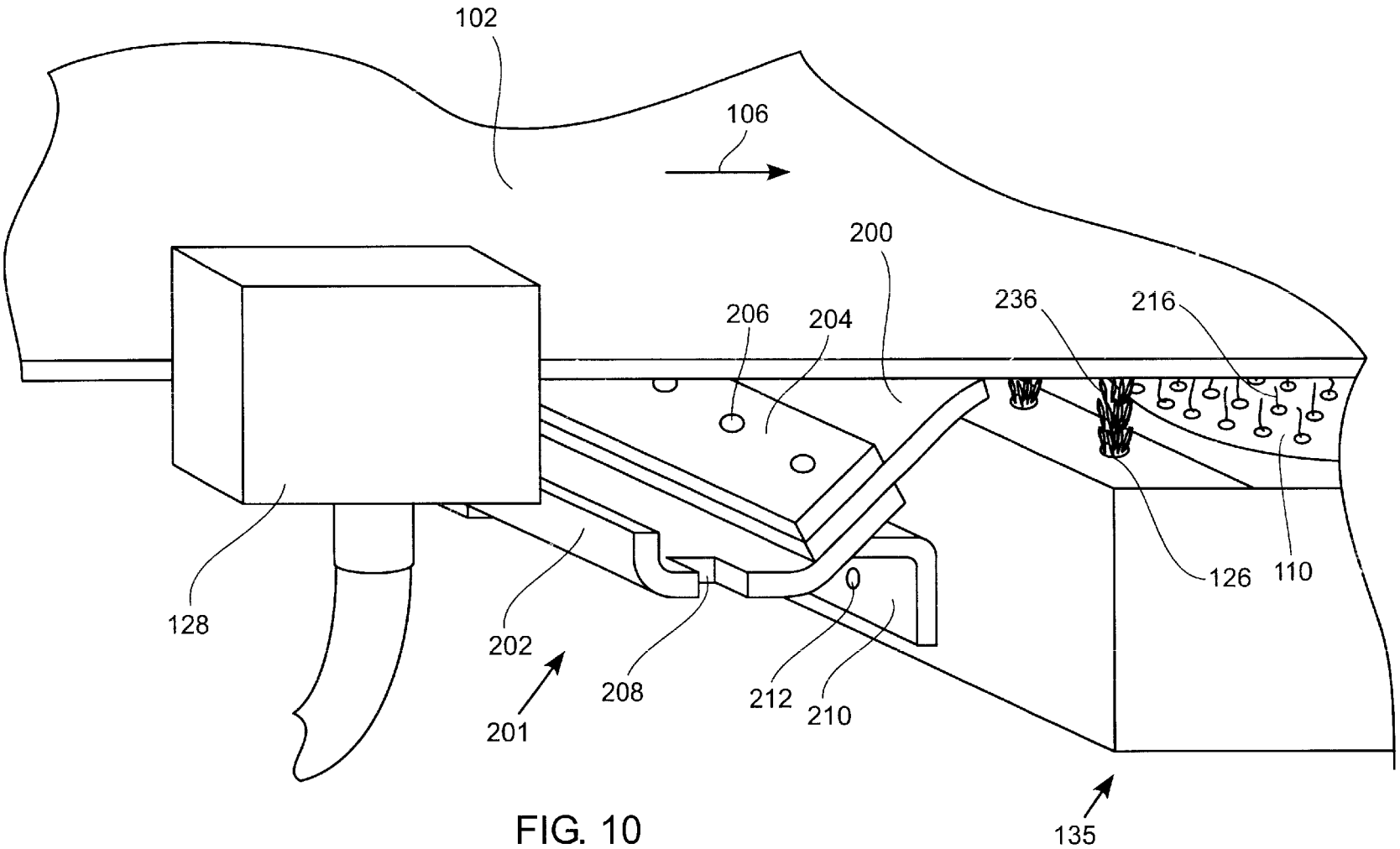
FIG. 10 is an illustration showing the belt wiper assembly incorporated into a CMP system that uses a pre-wet fluid in accordance with an alternate embodiment of the present invention.

FIG. 10 shows the belt wiper assembly 201 incorporated into a CMP system that uses a pre-wet fluid 236 in accordance with an alternate embodiment of the present invention. The pre-wet fluid 236 can be useful in some CMP processes wherein the undersurface of the belt pad 102 benefits from a rinsing operation prior to traversing the platen assembly 135.

Figure 11:
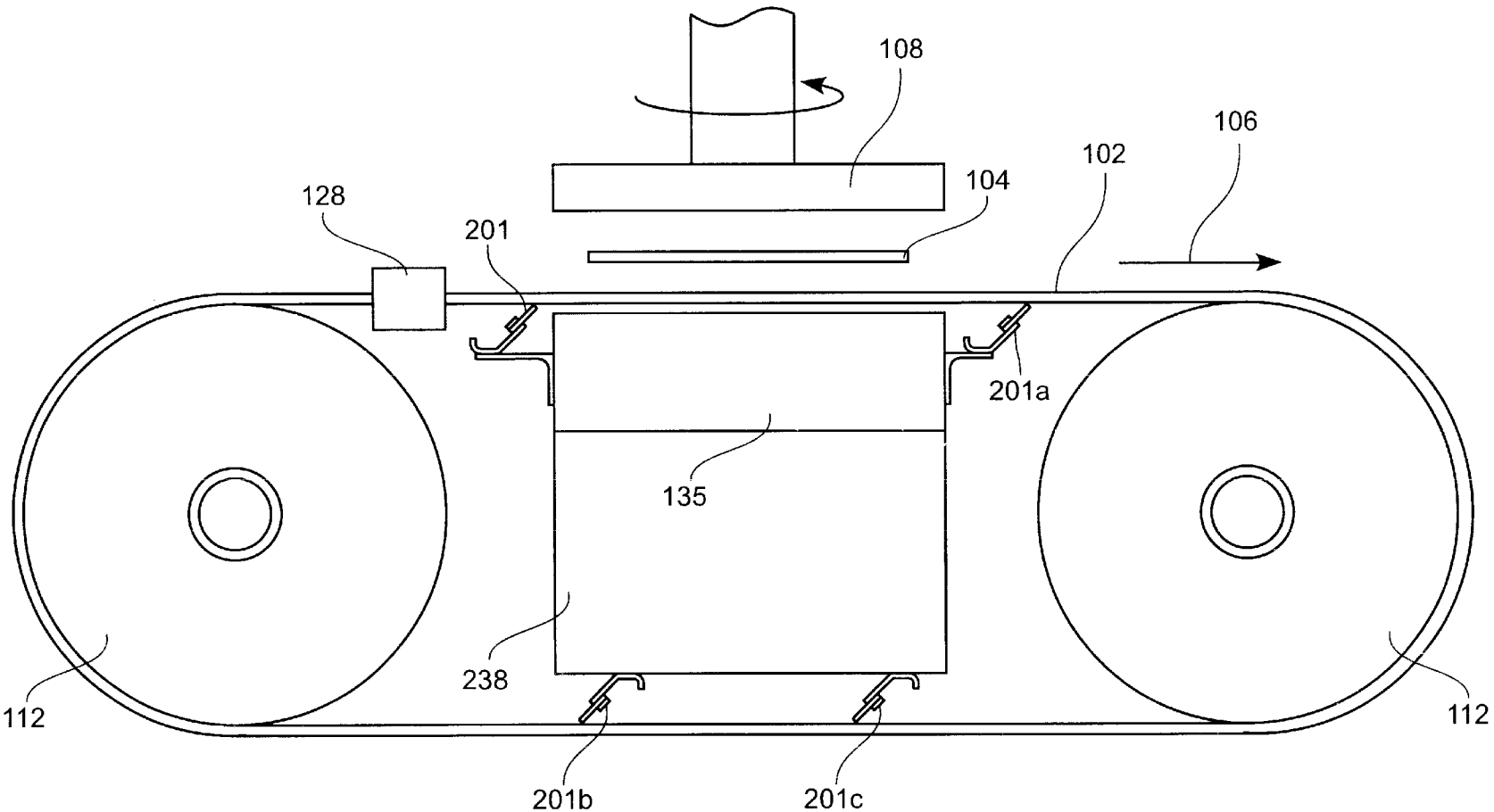
FIG. 11 is an illustration showing a side view of a plurality of wiper blade assemblies incorporated into a CMP system in accordance with an alternate embodiment of the present invention.

FIG. 11 shows a side view of a CMP system incorporating a plurality of belt wiper assemblies in accordance with an alternate embodiment of the present invention.

The belt wiper assembly 201 corresponds to the preferred embodiment of the present invention as previously discussed. A belt wiper assembly 201*a* corresponds to an alternate embodiment of the present invention wherein the belt wiper assembly 201*a* is configured to contact the undersurface of the belt pad 102 between a trailing edge of the platen assembly 135 and the second rotating drum 112. The belt wiper assembly 201*a* is useful for removing slurry 122, fluid, and particulate material from the undersurface of the belt pad 102 immediately after the belt pad 102 traverses the wafer preparation location 203. A belt wiper assembly 201*b* and a belt wiper assembly 201*c* correspond to an alternate embodiment of the present invention wherein the belt wiper assemblies 201*b* and 201*c* are configured to contact the undersurface of the belt pad 102 while being attached to the bottom of a platen housing 238. The belt wiper assemblies 201*b* and 201*c* may be configured to cross the belt pad 102 width W2 at an angle to enhance the removal of the slurry 122, fluid, and particulate material. The belt wiper assemblies 201*b* and 201*c* are useful for removing slurry 122, fluid, and particulate material that may fall from the belt wiper assemblies 201 and 201*a*.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the claimed invention.

What is claimed is:

1. A linear belt-type chemical mechanical planarization (CMP) system, comprising:

a first drum and a second drum;

a belt pad having a width, a preparation surface, and an undersurface, the belt pad being disposed around the first drum and the second drum, the belt pad configured to move linearly around the first drum and the second drum, the belt pad further configured to traverse over a wafer preparation location;

a platen being defined between the first drum and the second drum and inside of the belt pad, the platen providing support at the wafer preparation location; and a wiper blade disposed between the first drum and the second drum and inside of the belt pad, the wiper blade being configured to extend across width of the belt pad and to be in contact with the undersurface of the belt pad, the wiper blade being capable of removing fluid from the underside of the belt pad.

2. A linear belt-type CMP system as recited in claim 1, wherein the removing of fluid is performed beside the wafer preparation location at the undersurface of the belt pad.

3. A linear belt-type CMP system as recited in claim 1, wherein the wiper blade is configured to contact the undersurface of the belt pad in a non-perpendicular manner.

4. A linear belt-type CMP system as recited in claim 1, wherein the wiper blade is configured to contact the undersurface of the belt pad in a perpendicular manner.

5. A linear belt-type CMP system as recited in claim 1, further comprising a gutter, the gutter having a first end and a second end, the gutter being configured to flow fluid toward the first end and the second end, the first end and the second end being formed to direct a flow of fluid from the gutter.

6. A linear belt-type CMP system as recited in claim 1, wherein the wafer preparation location is located between a first platen side and a second platen side, the belt pad configured to traverse over the wafer preparation location in a direction from the first platen side to the second platen side, the first platen side containing a plurality of delivery holes through which a gas is delivered, the second platen side containing a plurality of delivery holes through which a liquid is delivered.

7. A linear belt-type CMP system as recited in claim 6, wherein the wiper blade is attached to the first platen side.

8. A linear belt-type CMP system as recited in claim 1, wherein a plurality of additional wiper blades are disposed between the first drum and the second drum and inside of the belt pad, each wiper blade being configured to extend across width of the belt pad and be in contact with the undersurface of the belt pad, each wiper blade being capable of removing fluid from the underside of the belt pad.

9. A belt wiper assembly for use in a chemical mechanical planarization (CMP) system, the CMP system including a linear polishing belt having a preparation surface and an undersurface, comprising:

a support body disposed within the linear polishing belt;

a bracket attached to the support body; and a blade attached to the bracket, the blade configured to contact the undersurface of the linear polishing belt.

10. A belt wiper assembly for use in a CMP system as recited in claim 9, wherein the blade is further configured to contact the undersurface of the linear polishing belt in a non-perpendicular manner.

11. A belt wiper assembly for use in a CMP system as recited in claim 9, wherein the blade is further configured to contact the undersurface of the linear polishing belt in a perpendicular manner.

12. A belt wiper assembly for use in a CMP system as recited in claim 9, wherein the bracket includes a gutter, the gutter being configured to extend across width of the belt pad, the gutter having a first end and a second end, the first end and the second end having a notch.

13. A belt wiper assembly for use in a CMP system as recited in claim 9, wherein the blade contacting the undersurface of the linear polishing belt is flexible.

14. A belt wiper assembly for use in a CMP system as recited in claim 9, wherein a blade surface contacting the undersurface of the linear polishing belt has a wedged shape.

15. A linear belt-type chemical mechanical planarization (CMP) system, comprising:

a first drum and a second drum;

a belt pad having a width, a preparation surface, and an undersurface, the belt pad being disposed around the first drum and the second drum, the belt pad configured to move linearly around the first drum and the second drum, the belt pad further configured to traverse over a wafer preparation location;

a platen being defined between the first drum and the second drum and inside of the belt pad, the platen providing support at the wafer preparation location; and a wiper blade disposed between the first drum and the second drum and inside of the belt pad, the wiper blade being configured to extend across width of the belt pad and to be in contact with the undersurface of the belt pad, the wiper blade being capable of removing particulate material from the underside of the belt pad.

16. A linear belt-type CMP system as recited in claim 15, wherein the removing of particulate material is performed beside the wafer preparation location at the undersurface of the belt pad.

17. A linear belt-type CMP system as recited in claim 15, further comprising a gutter, the gutter having a first end and a second end, the gutter being configured to direct particulate material toward the first end and the second end, the first end and the second end being formed to direct particulate material from the gutter.

18. A linear belt-type CMP system as recited in claim 15, wherein a plurality of additional wiper blades are disposed between the first drum and the second drum and inside of the belt pad, each wiper blade being configured to extend across width of the belt pad and be in contact with the undersurface of the belt pad, each wiper blade being capable of removing particulate material from the underside of the belt pad.

* * * * *